US006195923B1

(12) United States Patent
Gorman

(10) Patent No.: US 6,195,923 B1
(45) Date of Patent: Mar. 6, 2001

(54) DISPLAY METHOD AND STRUCTURE

(76) Inventor: Michelle L. Gorman, 717 Galleon Dr., Naples, FL (US) 34102

( * ) Notice: Subject to any disclaimer, the term of this patent is extended or adjusted under 35 U.S.C. 154(b) by 0 days.

(21) Appl. No.: 09/038,183

(22) Filed: Mar. 10, 1998

(51) Int. Cl.[7] ..... G09F 11/02
(52) U.S. Cl. ..... 40/479; 40/493
(58) Field of Search ..... 40/377, 379, 747, 40/479, 480

(56) References Cited

U.S. PATENT DOCUMENTS 293,850 * 3/1884 Carly ..... 40/479
979,707 * 12/1910 Rozell ..... 40/493
2,810,223 * 10/1957 Fraesdorf, Jr. ..... 40/479
3,090,142 * 5/1963 Anderson ..... 40/479
4,280,241 7/1981 Pfaff .
5,232,371 8/1993 Day-Cain .
5,626,365 5/1997 Petteway .

* cited by examiner

*Primary Examiner*—Cassandra H. Davis

(57) ABSTRACT

A display structure or a unique book including a plurality of laterally extending page supports each adapted to carry at least a pair of pages in a side-by-side relationship. Each page support has a pair of spaced support pallets and at least one pallet support leg extending between and connected to the spaced support pallets. A rotatably supporting structure is provided for each of the page supports so that when one of the support pallets is rotated, the other of the pair is rotated in tandem therewith. The pallet support legs are coupled to the rotatably supporting structure so that each of the support pallets extend radially outwardly from the rotatably supporting structure.

3 Claims, 6 Drawing Sheets

FIG. 8
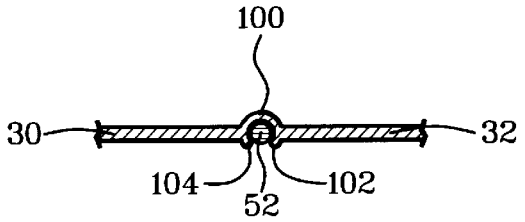
FIG. 9
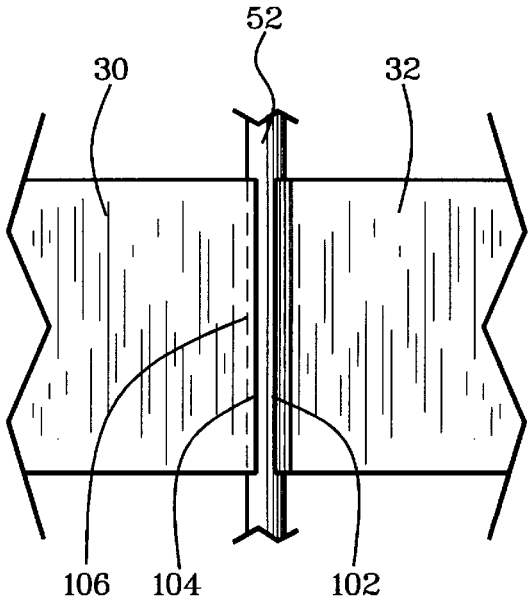
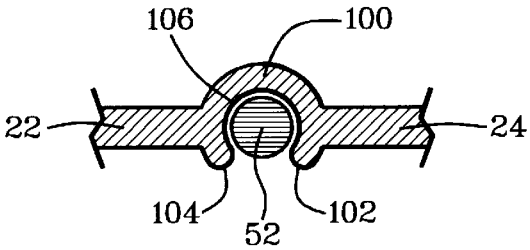
FIG. 10
FIG. 11
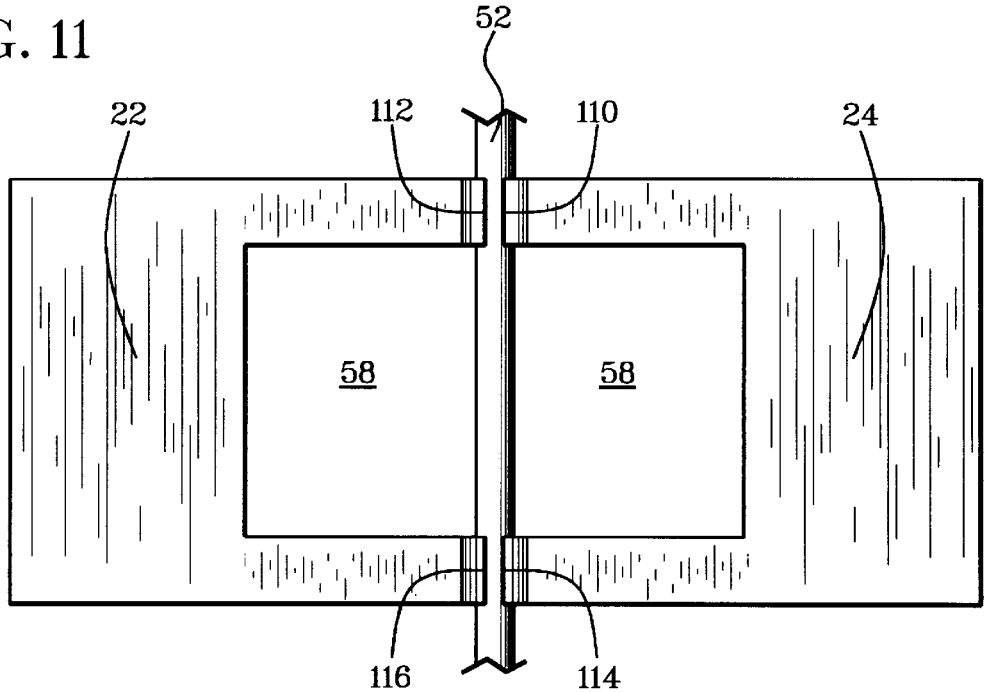

DISPLAY METHOD AND STRUCTURE

BACKGROUND OF THE INVENTION

1. Field of the Invention

This invention relates to a display method and structure generally and, in particular, to a display structure or book for displaying information and a method for displaying information.

One of the applications for this invention is to provide a unique reading system to read to and visually stimulate audiences from pre-school on up. Recent studies have shown that audio and visual stimulation from the time a child is born results in higher I.Q.'s when the child is older.

The display structure and method is designed so that the narrator (teacher, parent, etc.) is provided with indicia on one side of the display area of the structure, and the audience is supplied with the same indicia, or indicia of like content, (text, illustrations, photos, etc.) on the other side of the structure.

The narrator never has to turn the display structure around to show the audience pictures and/or text, so there is better comprehension on the part of the audience.

Thus, the face to face interaction allows the audience to watch the narrator's mouth form words and associate the words with the pictures/text on the audience side of the display. There is no neck craning or squinting to get a closer look as occurs when reading side by side. Further, the method and structure permits use with a much larger audience than side by side reading. In addition, the display structure can be easily made much larger and have larger indicia to accommodate even larger audiences.

The method and structure allows the audience to look directly at the narrator while the audience reads or views the same indicia at the same time. So, the audience can follow the text and view the illustrations or graphics as it is read or explained by the narrator, which enhances their reading skills as well as improving their attentiveness.

2. Description of the Prior Art

A patentability search revealed only one relevant patent, U.S. Pat. No. 5,626,365, issued May 6, 1997, entitled TWO-WAY BOOK (herein referred to as '365). The intended function of the '365 patent is similar to that of the present invention. But, there are substantial advantages in the structure and method of the present invention over the '365 patent. The ease of use of the present invention is much improved over '365, thereby reducing the wear and tear after extended use. In patent '365, the pages are in a standard ring member binder, which places a great deal of stress on the aligned ring receiving holes in the pages, allowing the pages to be easily torn out.

The present structure is more heavy duty and less prone to destruction, especially with respect to younger children. Pages can be easily replaced, or new pages with different indicia can be substituted for the original pages.

The connecting legs between pages of the present invention insure that the rotation of the pages automatically brings sets of indicia into view on both sides of the display structure.

While the invention is described in the first embodiment as laterally extending page supports for two pages, it has the advantage of being able to use the two-pages spread as a single extended or enlarged page. This enables enlarged illustrations or text, e.g. a panorama across both pages.

Further, because of the strength of the display structure, the pages can be substantially increased in size, both width and height. Thus, the display structure can be used for large amounts of instructional indicia, with enlarged illustration details for operation manuals or the like, which can be self-supporting without having to be held or propped up. Further, there is no worry that pages will be inadvertently turned by breezes or drafts, so that the same information continues to be available once the display structure is placed in the self-supporting position. Other advantages will become apparent in the description.

Finally, the pages of the '365 patent in a standard binder must be turned individually and successively, which is not only awkward but can lead to errors in what is desired to be displayed.

Accordingly, it is an object of this invention to provide an improved display method and a display structure.

It is a further object of this invention to provide a method and structure for displaying indicia which allows audiences to view the same indicia as being discussed by the narrator to enhance understanding, gain comprehension and improve the audience's attentiveness.

A still further object of this invention is to provide a method and structure which has pages that can be easily replaced, or new pages with different indicia can be substituted for the original pages.

Yet another object of this invention is to provide a method and structure which is much more sturdy and longer lasting than prior art approaches.

Other objects, advantages and features will become apparent when the description of the invention is taken in conjunction with the accompanying drawings.

SUMMARY OF THE INVENTION

A method for displaying indicia includes the following steps. A plurality of pairs of laterally extending page supports are provided. Rotatably supporting the plurality of pairs of page supports in between the lateral ends thereof so that each page support extends radially from their supported position, whereby when one of the page supports of a pair is rotated the other page support is rotated in tandem therewith.

Indicia is provided on both sides of each page support in a back-to-back relationship. Sequential page designations are applied on each pair of adjacent facing page supports in a first half of the page supports in the rotational sequence. Identical page designations are applied on a second half of the page supports in the rotational sequence which repeat the same sequential page designations that are on each pair of adjacent facing page supports of the first half of the page supports. Providing each of the page supports which have the same page designation with identical indicia, or indicia of like content, thereon whereby when the pages are rotated to view any pair of consecutive sequential designations on one side of the display the same indicia is also available on the reverse side of the display. A step of applying indicia directly to the page supports allow them to act as pages. Alternatively, separate pages with indicia thereon may be affixed to the page supports.

Structurally, the display may include a plurality of pairs of sheets, each sheet having front and rear opposed surfaces. Binding the pairs of sheets into a display structure with means for rotatably supporting the pairs of sheets, and means for connecting each pair of sheets together whereby the pairs of sheets extend radially from the rotatably supporting means, and whereby when one sheet in each pair is rotated the other sheet in each pair is rotated in tandem therewith. The connecting means are coupled to the rotatable supporting means.

As an alternative, the display structure may include a plurality of laterally extending page supports, each adapted to carry at least a pair of pages in a side-by-side relationship. Each page support may include at least a pair of spaced support pallets and at least one pallet support leg extending between and connected to the spaced support pallets.

Means are provided for rotatably supporting each of said page supports so that when one of the support pallets is rotated around the rotatably supporting means, the other support pallet of that page support is rotated in tandem therewith. Means for coupling each pallet support leg of each page support to the rotatably supporting means, whereby the support pallets extend radially outwardly from the rotatably supporting means.

BRIEF DESCRIPTION OF THE DRAWINGS

In the drawings, where like numerals are employed to designate like parts throughout:

FIG. 8 is a plan view of a second embodiment of this invention illustrating an alternative for rotatably mounting page supports on a binder pivot shaft;

FIG. 9 is a front elevational view of a page support illustrated in FIG. 8;

FIG. 10 is an enlarged view of the second embodiment shown in FIG. 8;

FIG. 11 is a front elevational view of a page support which is different from the page support illustrated in FIG. 8.

DESCRIPTION OF PREFERRED EMBODIMENTS

Figure 1:
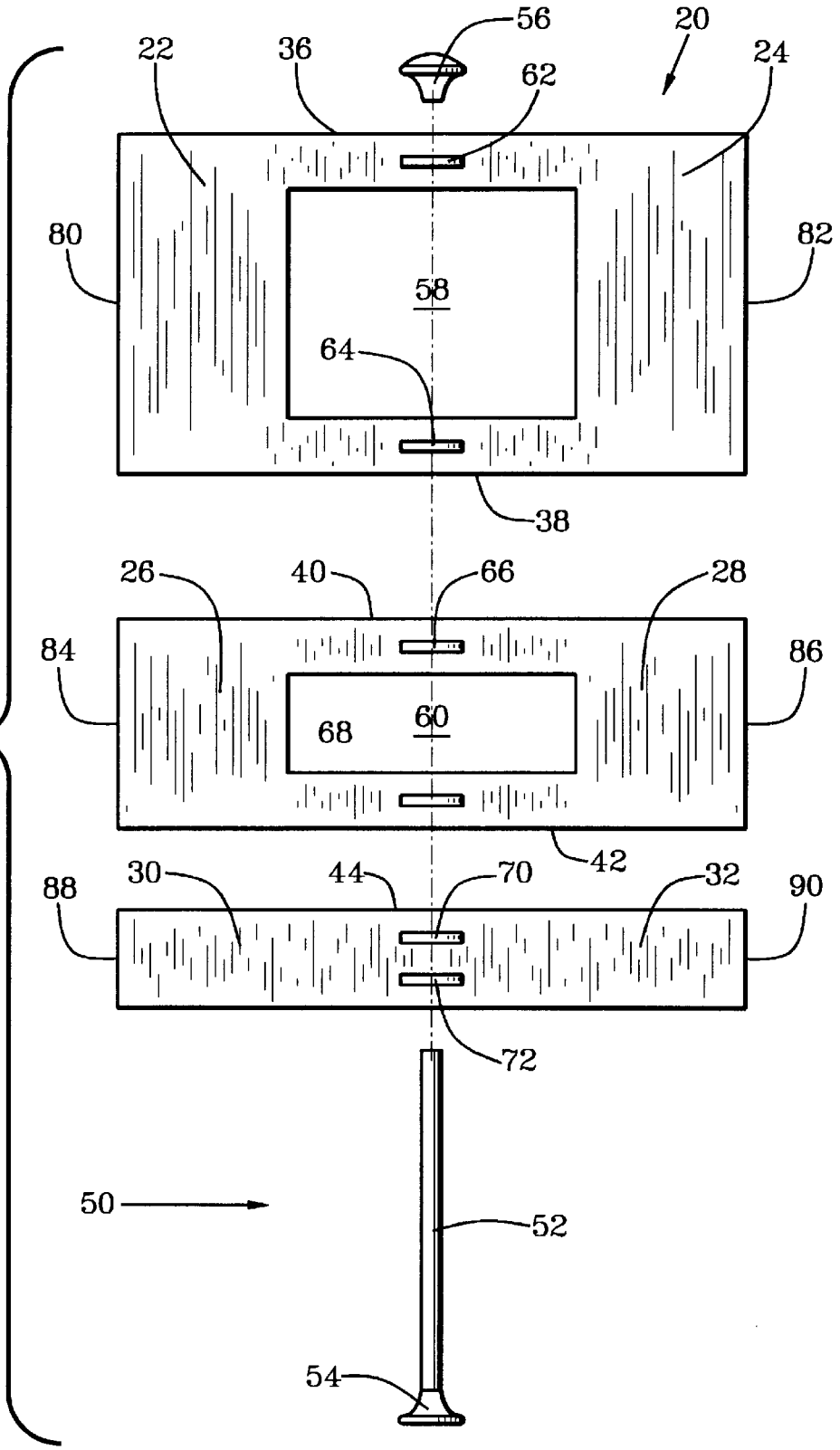
FIG. 1 is an exploded view of a first embodiment of this invention.

Referring now to FIG. 1 there is illustrated an exploded view of a first embodiment 20 of this invention, which includes a plurality of pairs of sheets 22, 24 and 26, 28 and 30, 32. Each sheet has front and rear opposed surfaces.

Means for binding the pairs of sheets into a display structure or unique book include means for rotatably supporting the pairs of sheets, and means for connecting each pair of sheets together whereby the pairs of sheets extend radially from the rotatably supporting means so that when one sheet in each pair is rotated, the other sheet in each pair is rotated in tandem therewith. Further, means for coupling each connecting means to the rotatably supporting means are shown.

In FIG. 1, a pair of laterally extending connecting means 36, 38 connect the pair 22, 24 together. The connecting means 36, 38 and pair of sheets 22, 24 define an aperture 58, while edges 80, 82 define the lateral ends of this connected structure.

A pair of laterally extending connecting means 40, 42 connect the pair of sheets 26, 28 together. The connecting means 40, 42 and pair of sheets 26, 28 define an aperture 60, while edges 84, 86 define the lateral ends of this connected structure.

Finally, a single laterally extending connecting means 44 connects the pair of sheets 30, 32 together while edges 88, 90 define the lateral ends of this connected structure. Since, the three pairs illustrate the structure and function of this invention, no further pairs are shown and there is no need for a centrally located aperture in the structure with the pair of sheets 30, 32.

The rotatably supporting means 50 in this embodiment includes a pivot shaft 52 and end retainers 54, 56 to keep the supported pairs of pages on the pivot shaft.

Figure 2:
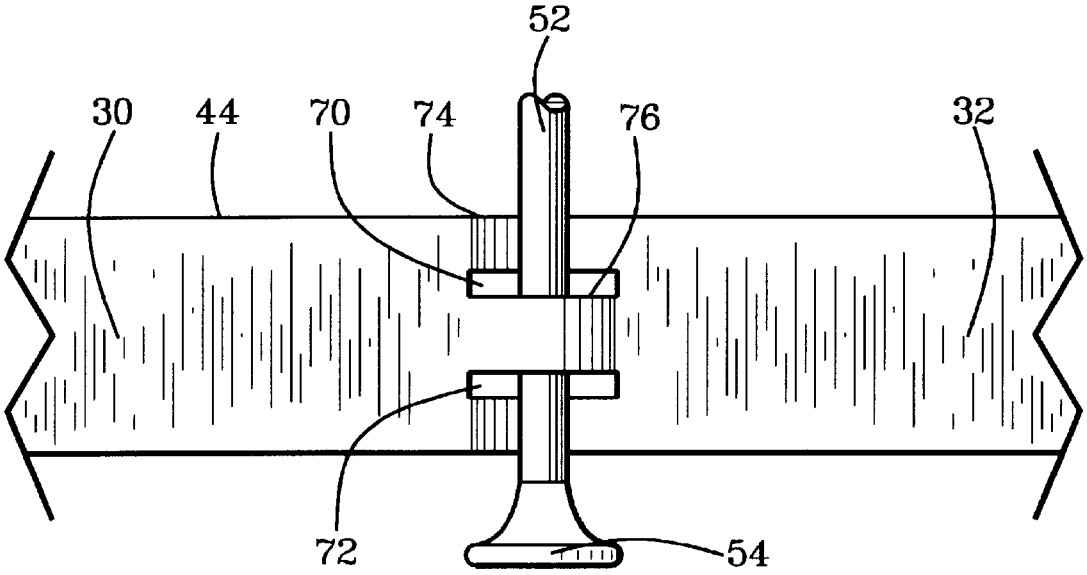
FIG. 2 is a front elevational view of a page support which may be utilized in the first embodiment of this invention.
Figure 3:
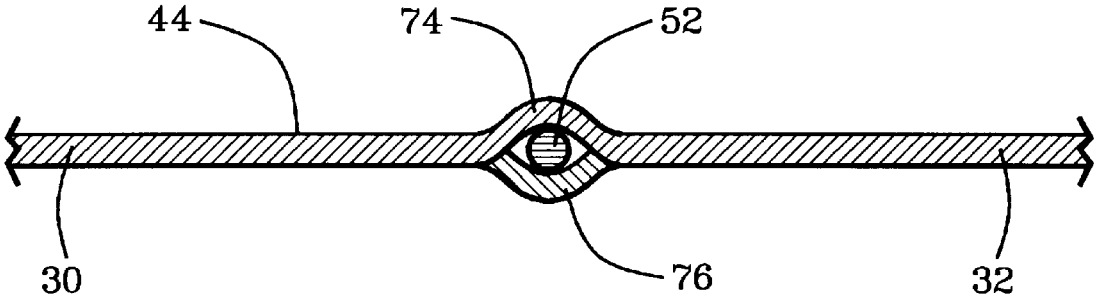
FIG. 3 is a plan view of the page support illustrated in FIG. 2.

To assemble the pairs of sheets together, the slots 62, 64, and 66, 68 and 70, 72 in the respective connecting members are used. As shown in FIGS. 2 and 3, the slots are used to enable adjacent portions of each connecting means to be pushed in opposite directions in order to pass sections thereof on opposite sides of the pivot shaft to provide bearing surfaces.

In FIG. 2, the slots 70, 72 enable the section of connecting means between slots 70, 72 to be pushed in one direction, and the sections of connecting means outside of the slots 70, 72 to be pushed in an opposite direction, enabling the pivot shaft 52 to be pushed between the separated sections to provide bearing surfaces on each side of pivot shaft to support rotation of sheets 30, 32 around the pivot shaft 52. This is further illustrated in FIG. 3 where section 74 is pushed in one direction and section 76 is pushed in the opposite direction.

In FIG. 3, a section 74 of connecting means is pushed in one direction while a section 76 is pushed in the opposite direction to pass the sections on opposite sides of shaft 52, to hold the shaft 52 in a rotatably supporting position. These bearing surfaces comprise coupling means for attaching the connecting means to the pivot shaft in a rotatably supported position.

Figure 4:
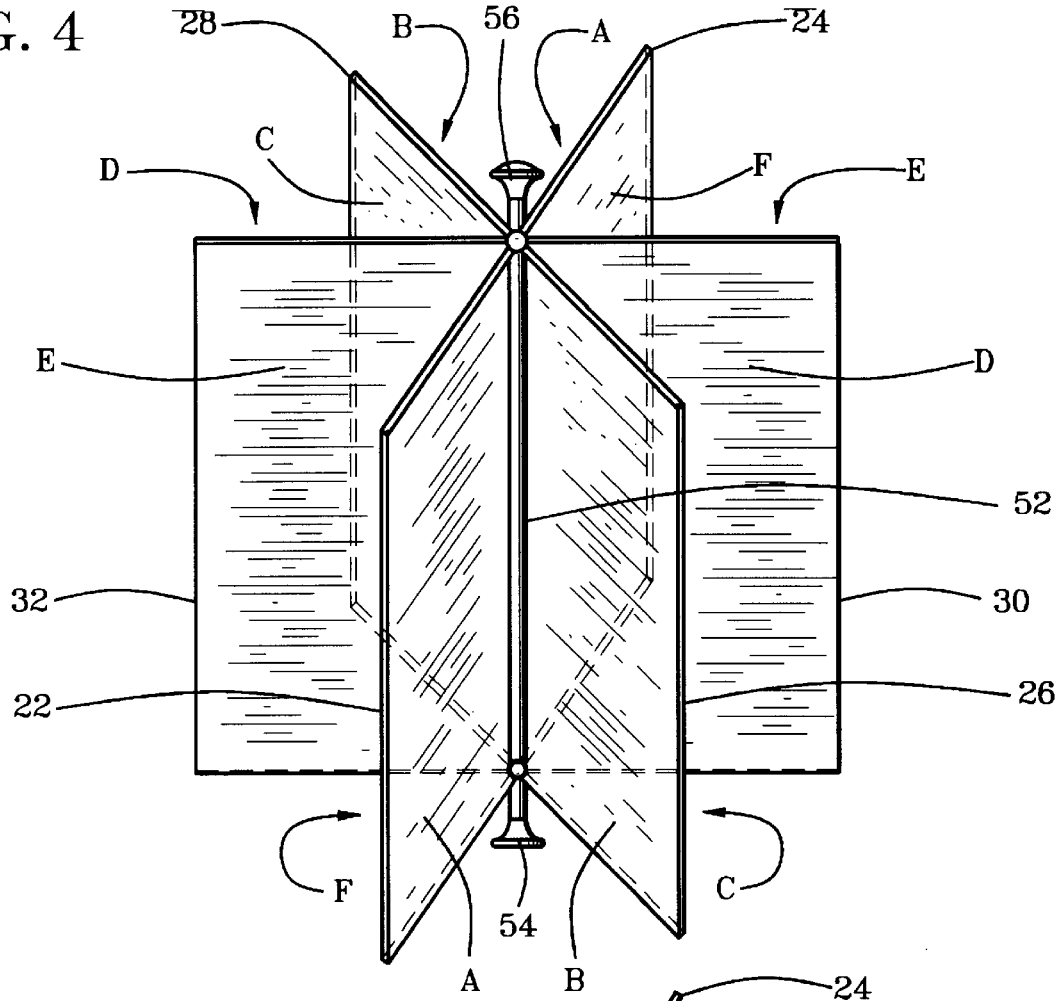
FIG. 4 is a view in perspective of an assembled plurality of page supports rotatably mounted on a binder pivot shaft.
Figure 5:
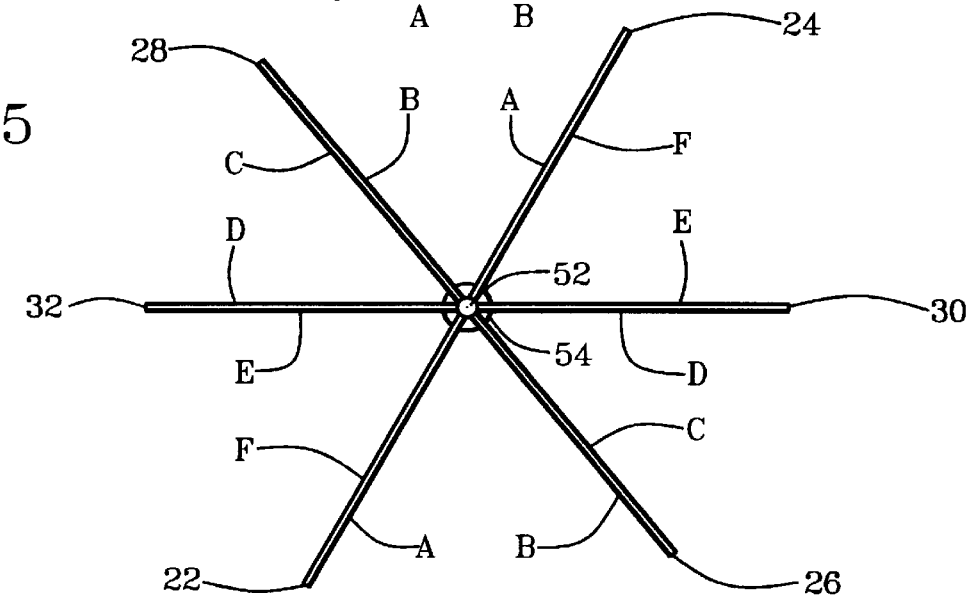
FIG. 5 is a plan view of the assembled plurality illustrated in FIG. 4.
Figure 6:
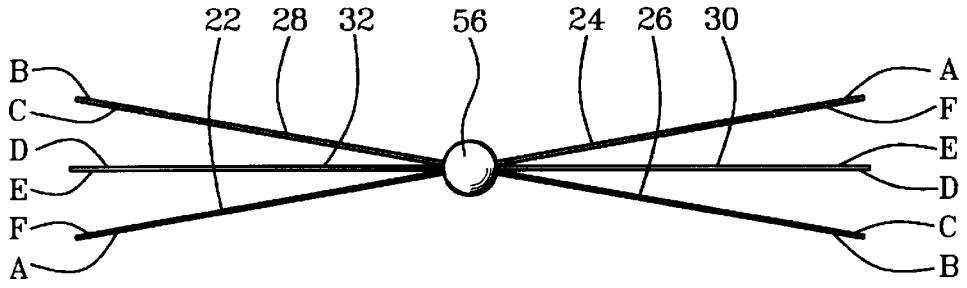
FIG. 6 is a plan view of FIG. 5 which illustrates the rotation of the page supports into a flat stack of pages.

When the pairs of sheets are assembled together as shown in FIGS. 4, 5 and 6, the connecting means 36, 38 and 40, 42 and 44 are spaced along the pivot shaft 52 so that there are interstices formed between each of the connecting means.

In this embodiment, the height of aperture 58 exceeds the height of sheets 26, 28 and connecting means 40, 42. Therefore, the pairs of sheets 26, 28 and connecting means 40, 42 can pass through aperture 58.

Similarly, the height of aperture 60 exceeds the height of sheets 30, 32 and connecting means 44. Therefore, the pairs of sheets 30, 32 and connecting means 44 can pass through aperture 60.

Thus, when the pairs of sheets are so assembled, and the slots in each of the connecting means are vertically aligned, the pivot shaft 52 can be threaded up through the separated sections of connecting means to have sections of each connecting means pass on opposite sides of the shaft 52. The plurality of pairs of sheets are rotatably supported on shaft 52 between the lateral ends 80, 82 and 84, 86 and 88, 90 of the pairs of sheets.

To retain the plurality of pairs of sheets on shaft 52, a retaining means 54 is placed on the bottom of shaft 52, while a retaining means 56 is placed on the top of shaft 52. The retaining means 54, 52 may be secured on shaft 52 in a number of well known ways. For example, screw threads can be formed on the outside of shaft 52, while internal threads are formed in each of the retainers 54, 56.

FIGS. 4 and 5 illustrate perspective and plan views, respectively, of an assembled plurality of pairs of sheets or page supports rotatably mounted or supported on pivot shaft 52. These two Figures are directed to showing general layout, function, and operation. Therefore, to show such, the details of FIGS. 1 to 3 are not included so that the invention can be presented simply for a better understanding In this context, it should be noted that although sheets are referred to in the description above, the term "sheets" includes a pair of pages affixed to each other in a back-to-back relationship, a pair of pages affixed to a page support or sheet support pads, laterally extending page supports adapted to carry at least a pair of pages in a side-by-side relationship which includes at least a pair of spaced support pallets and at least one pallet support leg, and the like in equivalents.

In FIGS. 4, 5 and 6 the first half of page supports in the rotational sequence, e.g. sheets 22, 26, 30, and 24, have sequential page designations A, B, C, D, E and F applied to adjacent facing page supports. The second half of page supports, in the rotational sequence e.g. sheets 24, 28, 32, and 22 have the same sequential page designations A, B, C, D, E, and F on each pair of adjacent facing page supports.

Each of the page supports which have the same page designations have identical indicia thereon, whereby when said pages are rotated to view any pair of consecutive sequential designations on one side of the display structure, the same indicia is also available on the other side of the display structure.

Figure 7:
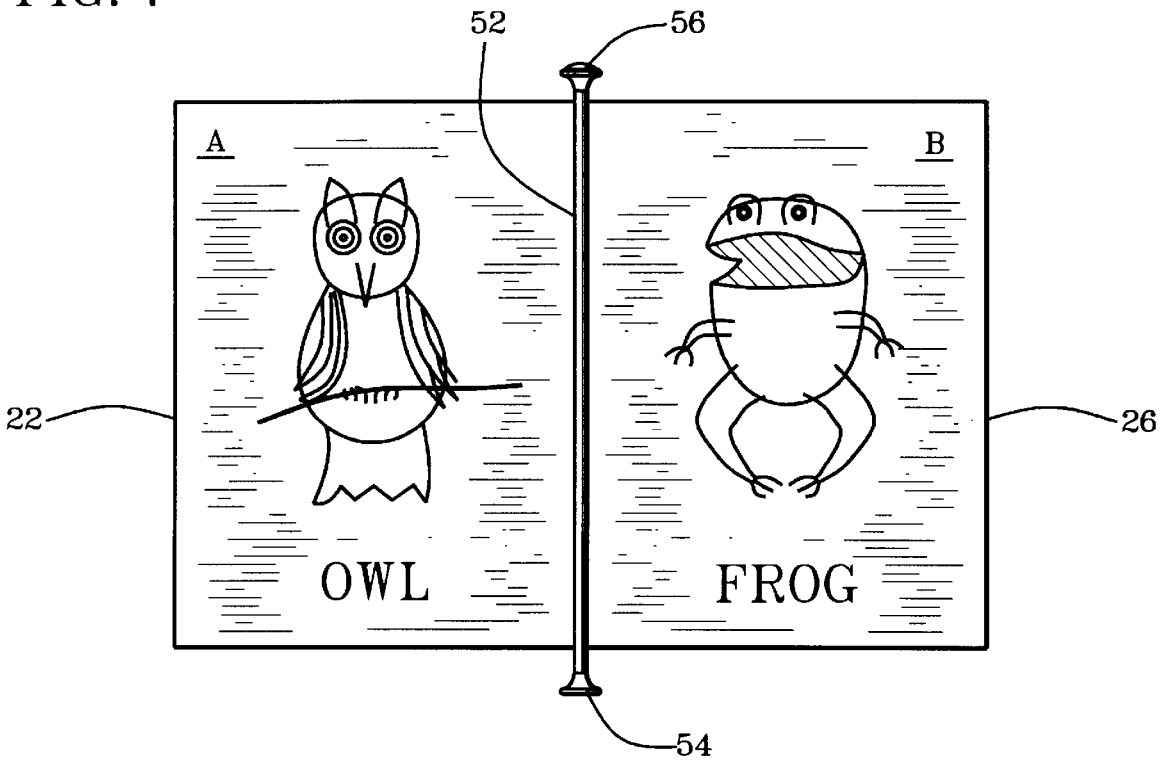
FIG. 7 is a front elevational view of the assembly of FIG. 4 showing text and/or indicia on adjacent pages.

FIG. 7 illustrates indicia in the form of text, illustrations, etc. that may be used. While there are references herein to "the same indicia" or "identical indicia", those terms are meant to generally cover indicia of "like content". For example, in FIG. 7, the indicia shown includes illustrations and text. However, when used in applications where the audience is hearing impaired, it may be desirable to have text in alphabetical form on one side of the display, and on the other side of the display show the message in graphical illustrations of sign language. Thus, while the indicia on opposite sides of the display have a different appearance, the content of the messages on both sides is the same. So, the "text" is of like content. The sheets or page supports may be formed from paper, cardboard, flexible plastic, relatively rigid plastic or other materials.

Referring now to FIGS. 8 to 10 there is illustrated a second embodiment of this invention which discloses a specific type of bearing means to couple the sheets, page supports, etc. in a rotatably supported position on the pivot shaft.

In this embodiment the sheets, page supports, etc. are preferably formed from molded plastic. Sheets 30, 32 have a bearing 100 molded in the middle intermediate the lateral ends of sheets 30, 32. Bearing 100 may be cylindrical having an internal bearing surface 106 to journally receive pivot shaft 52. The cylindral bearing 100 has a slot formed in the side thereof parallel to the pivot shaft. The slot has facing slot walls 102, 104 which are spaced apart a distance less than the diameter of shaft 52, thereby retaining shaft 52 in said bearing. The bearing is formed of a material such as plastic, spring type metal, and the like. This enables the slot to be temporarily widened to accept the pivot shaft into the bearing, by a press fit, for example. After the shaft is journaled in the bearing, the slot returns to its original size or width to retain the shaft in the bearing.

It should be noted that the cylindrical bearing can be formed without the slot in the side. However, this would not be as convenient for assembly or for replacing or substitution of pages.

This structure provides a heavy duty and sturdy means for coupling a pair of sheets in a rotatably supported position. Further, it makes it very easy to replace damaged sheets, or to substitute new sheets with new indicia in the display structure.

Referring now to FIG. 11, this type of bearing is used to rotatably support sheets 22, 24. Slots are formed in both the upper and lower connecting legs or means, having slot walls 110, 112 and 114, 116, respectively.

Figure 12:
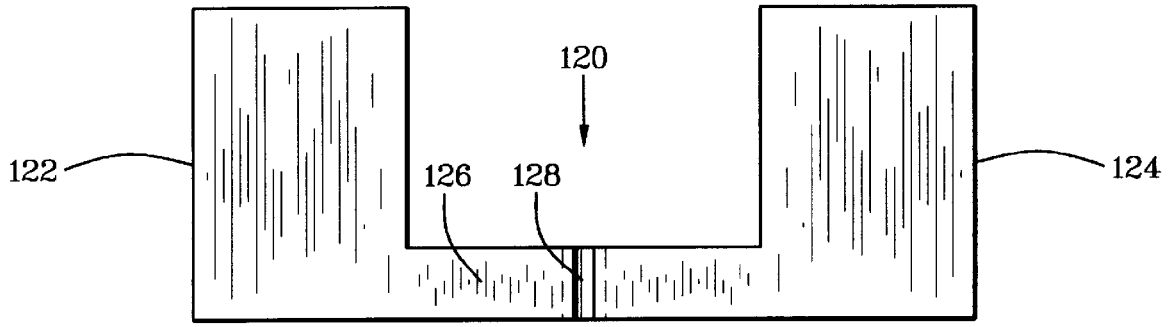
FIG. 12 is a front elevational view of a third embodiment of this invention illustrating a laterally extending page support to be used with those shown in FIGS. 13 and 14.
Figure 13:
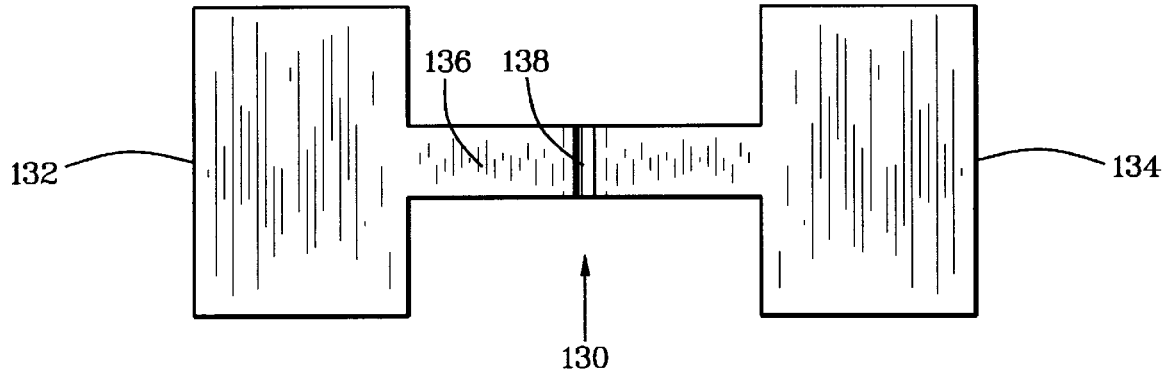
FIGS. 13 and 14 are front elevational views of laterally extending page supports.
Figure 14:
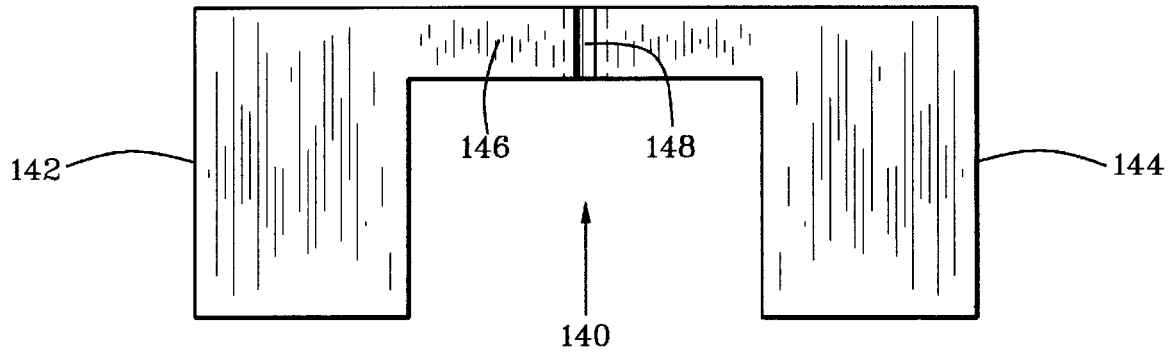

FIGS. 12, 13 and 14 illustrate a third embodiment of this invention. In FIG. 12 a laterally extending page support 120, is adapted to carry at least a pair of pages in a side-by-side relationship. Support 120 includes at least a pair of spaced support pallets 122, 124 and at least one pallet support leg 126 extending between and connected to the support pallets. A bearing means 128 intermediate the length of the page support is formed in the support leg 126. This bearing means has already been illustrated and described in FIGS. 8 to 11.

In FIG. 13, a laterally extending page support 130 includes at least a pair of spaced support pallets 132, 134 and a pallet support leg 136 with a bearing means 138 formed therein.

In FIG. 14, a laterally extending page support 140 includes a pair of spaced support pallets 142, 144 and a pallet support leg 146 with a bearing means 148 formed therein.

To assemble the page supports 120, 130 and 140 into a display structure or unique book, each page support has its bearing means snapped onto a pivot shaft so that all three page supports are rotatably supported. While the order of assembly of the page supports onto the pivot shaft is not crucial, the easiest order appears to be snapping page support 120 on the pivot shaft first, then page support 130, and finally page support 140. This couples the page supports to the pivot shaft whereby each page support pallet extends radially outwardly from the pivot shaft.

The pallet support legs are to be spaced along the pivot shaft so that there are interstices therebetween, so that there is no interference with other leg supports when a page support is rotated.

This embodiment is especially well suited for formation with a plastic molding process, since the strength of the molded plastic enables the reduction of the size of the pallet support legs. Thus, many more laterally extending page supports can be assembled on a pivot shaft.

In all of the embodiments disclosed herein, the various relative dimensions of the components shown in the drawings are not to be taken as limiting since they are illustrated in dimensions that make the explanation of the operation, function, etc. more readily understandable. For example, the support pallets may be made larger, and the pallet support legs may be smaller, etc., depending upon the application and the result to be achieved.

As in the other embodiments, the spaced pallets may receive indicia directly thereon, or separate pages may be affixed to the spaced pallets. It should be noted again that the sheets or support pallets can support pages that are larger than the size of the sheets or pallets, so that all of the pages in the display structure are of the same size.

While the choice of the specific components and their arrangement in the embodiments described herein illustrate the results and advantages obtained by the choice of those specific components over the prior art, the invention is not limited to those components and their arrangement. Thus, the forms of the invention shown and described herein are to be taken as illustrative, and changes in the components or their arrangement may be made without departing from the spirit and scope of this invention. There has been disclosed method apparatus which differs from, provides functions not performed by, and has clear advantages over the prior art.

I claim:

1. A method for displaying indicia, including the steps of;

(a) providing a plurality of pairs of laterally extending page supports, each having lateral ends, (b) rotatably supporting each of said plurality of pairs of page supports in between said lateral ends thereof so that each page support extends radially from their rotatably supported position, whereby when one of said page supports of a pair is rotated the other page support of said pair is rotated in tandem therewith, (c) providing indicia on each said of each page support in a back-to-back relationship, (d) applying sequential page designations on each pair of adjacent facing page supports of a first half of the page supports in the rotational sequence.

(e) starting on a second half of the page supports of the rotational sequence and repeating the application of the same sequential page designations on each pair of adjacent facing page supports, and (f) providing each of said page supports which have the same page designation with identical indicia thereon, whereby when said pages are rotated to view any pair of consecutive sequential designations on one side of said display the same indicia is also available on the reverse side of the display.

2. A method as defined in claim 1 which further includes the step of applying indicia directly on said page supports.

3. A method as defined in claim 1 which includes the step of affixing separate pages carrying indicia to said page supports.

* * * * *